US006889606B2

(12) United States Patent
Emura et al.

(10) Patent No.: US 6,889,606 B2
(45) Date of Patent: May 10, 2005

(54) CONVERSION CURVE SETTING SYSTEM

(75) Inventors: Hidetaka Emura, Fuchu (JP); Shigeki Fukuoka, Fuchu (JP)

(73) Assignee: Ryobi Limited, Fuchu (JP)

( * ) Notice: Subject to any disclaimer, the term of this patent is extended or adjusted under 35 U.S.C. 154(b) by 957 days.

(21) Appl. No.: 09/791,635

(22) Filed: Feb. 26, 2001

(65) Prior Publication Data

US 2001/0030768 A1 Oct. 18, 2001

(30) Foreign Application Priority Data

Apr. 5, 2000 (JP) ..... P2000-103115

(51) Int. Cl.[7] ..... B41F 31/02; B41B 1/00

(52) U.S. Cl. ..... 101/365; 101/211; 101/485; 358/518; 358/523; 358/1.16

(58) Field of Search ..... 101/365, 366, 101/368, 350.1, 350.2, 350.3, 350.4, 350.5, 351.3, 352.01, 352.02, 352.09, 483, 484, 485; 358/378, 523, 1.16

(56) References Cited

U.S. PATENT DOCUMENTS

| | | | | | |
|---|---|---|---|---|---|
| 4,763,359 | A | * | 8/1988 | Tsunoda et al. | 382/112 |
| 5,224,421 | A | * | 7/1993 | Doherty | 101/211 |
| 5,524,542 | A | * | 6/1996 | Toyama | 101/485 |
| 5,832,830 | A | * | 11/1998 | Rancourt et al. | 101/365 |
| 5,921,184 | A | * | 7/1999 | Sugiyama et al. | 101/484 |
| 6,006,662 | A | * | 12/1999 | Ishida et al. | 101/141 |
| 6,204,873 | B1 | * | 3/2001 | Shimazaki | 347/172 |
| 6,318,260 | B1 | * | 11/2001 | Chu et al. | 101/365 |
| 6,318,266 | B1 | * | 11/2001 | Weill | 101/490 |
| 6,341,175 | B1 | * | 1/2002 | Usami | 382/167 |

FOREIGN PATENT DOCUMENTS

| | | |
|---|---|---|
| DE | 36 20 152 A 1 | 1/1987 |
| DE | 41 26 562 A 1 | 2/1993 |
| JP | A 58-166056 | 10/1983 |
| JP | A 7-56498 | 3/1995 |
| JP | 7-117219 A | 5/1995 |
| JP | A 8-1914 | 1/1996 |
| JP | A 9-26336 | 1/1997 |
| JP | A 11-138757 | 5/1999 |

* cited by examiner

*Primary Examiner*—Eugene H. Eickholt
(74) *Attorney, Agent, or Firm*—Oliff & Berridge, PLC

(57) ABSTRACT

A conversion curve setting system comprises an initial data storage device, a conversion curve display device, a setting device, a past data storage device and a past data display device. The initial data storage device stores the initial data. The initial data define setting conditions for amounts of supplied ink of an ink supply adjusting apparatus relative to an image area ratio. The conversion curve display device displays a conversion curve on a display device on the basis of the initial data stored by the initial data storage device. The setting device sets the setting conditions for the amounts of supplied ink of the ink supply adjusting apparatus relative to the image area ratio, through operation by an operator. The past data storage device stores past data of the setting conditions for the amounts of supplied ink of the ink supply adjusting apparatus relative to the image area ratio, which setting conditions have been set by the setting device. The past data display device displays the past data stored by the past data storage device, together with the conversion curve on the display device.

16 Claims, 6 Drawing Sheets

CONVERSION CURVE SETTING SYSTEM

BACKGROUND OF THE INVENTION

1. Field of the Invention

The present invention relates to a conversion curve setting system, which is utilized, for example, for an offset printing machine or the like, for setting a conversion curve, which defines openings of ink keys and the number of rotations of an ink fountain roller.

2. Description of the Related Art

In a printing machine, an amount of ink supplied on a surface of a sheet of paper or the like to be printed can be increased or decreased by the number of rotations of an ink fountain roller and openings of a plurality of ink keys, which are placed in the longitudinal direction of the ink fountain roller. Change in openings of the ink keys causes the gaps between the ink keys and the ink fountain roller to vary so as to adjust an amount of ink supplied. A preset operation for the number of rotations of the ink fountain roller and the openings of the ink keys is carried out prior to a start of printing operation, in order to obtain an optimum printing density. Substitution of the image area ratio, which is obtained by calculation of the image area for each of columns corresponding to the ink keys, into a predetermined conversion formula (i.e., a predetermined conversion curve) provides preset values for the openings of the ink keys and the number of rotations of the ink fountain roller.

With respect to a conversion curve setting system for setting such a conversion curve, there has conventionally been known an ink supply adjusting method in which there is conducted learning of the openings of the ink keys, by which a proper printing density can be obtained in an actual printing operation (Japanese Laid-Open Patent Application No. H7-117219). According to the above-mentioned ink supply adjusting method, a new target value is obtained by multiplying the opening of the ink key device, which is determined from the image area ratio, by correction factor stored by a correction factor storage device. In a correction factor modification device, there is conducted learning of the results of the adjusted opening of the ink key device by an operator, so as to modify the correction factor, thus permitting a proper printing in an actual operation. The above-described ink supply adjusting method makes it possible to cause the opening of the ink key device to approximate an optimum opening in case of carrying out a similar printing operation.

The ink supply adjusting method described above is suited for the similar printing operation. However, the adjusted openings of the ink keys may vary depending on ambient temperature, adjusting condition of components of the printing machine, a kind of ink to be used, a pattern to be printed and the like, even when the image area ratio is kept unchanged. As a result, it is difficult to modify the correction factor in the correction factor modification device in an appropriate manner, thus making it impossible to obtain the optimum openings of the ink keys.

SUMMARY OF THE INVENTION

An object of the present invention is therefore to provide a conversion curve setting system by which the optimum openings of the ink keys and the optimum number of rotations of the ink fountain roller can be obtained in correspondence to many kinds of printing method.

In order to attain the aforementioned object, at least one initial datum defining setting conditions for amounts of supplied ink of an ink supply adjusting apparatus relative to an image area ratio is stored in an initial data storage device. A conversion curve is displayed on a display device on the basis of a conversion curve. Past data of the openings of ink keys relative to an image area ratio and the number of rotations of an ink fountain roller, which data have previously been set, are stored in a past data storage device. The past data is displayed together with the conversion curve on the display device. An operator can set the conversion curve in an optimum manner, making reference to the past openings of the ink keys and the past number of rotations of the ink fountain roller relative to the image area ratio, which are displayed on the display device. More specifically, the conversion curve setting system of the present invention comprises an initial data storage device for storing at least one initial datum, said at least one initial datum defining setting conditions for amounts of supplied ink of an ink supply adjusting apparatus relative to an image area ratio; a conversion curve display device for displaying a conversion curve on a display device on the basis of said at least one initial datum stored by said initial data storage device; a setting device for setting the setting conditions for the amounts of supplied ink of the ink supply adjusting apparatus relative to the image area ratio, through operation by an operator; a past data storage device for storing past data of the setting conditions for the amounts of supplied ink of the ink supply adjusting apparatus relative to the image area ratio, which setting conditions have been set by said setting device; and a past data display device for displaying said past data stored by said past data storage device, together with said conversion curve on said display device. Combination of a roller device for supplying ink from an ink fountain with ink key devices that are arranged in the longitudinal direction of the ink fountain roller so as to permit adjustment of openings between the devices and the outer peripheral surface of the ink fountain roller, which combination may include any other optional device, may be used as the ink supply adjusting apparatus. The setting conditions for then amounts of supplied ink correspond to the openings of the ink key devices, the number of rotations of the ink fountain roller and the like.

There may be adopted a structure in which said conversion curve display device displays said conversion curve in the form of a graph on said display device; and said past data display device plots said past data on said graph.

There may be adopted a structure in which there is provided a printing information input device for inputting printing information related to said past data through operation by the operator; said past data storage device stores said printing information inputted by said printing information input device; and said past data display device displays said printing information stored by said past data storage device on said display device. The printing information may include information having an influence on printing results, i.e., the name of ink, ink temperature, kind of additive, a date, a work number, the name of customer, a file name as printed, and the like.

The conversion curve setting system of the present invention may further comprise an initial data renewal device for renewing said at least one initial datum on the basis of data of the setting conditions for the amounts of supplied ink of the ink supply adjusting apparatus relative to the image area ratio, which setting conditions have been set by said setting device.

There may be adopted a structure in which said at least one initial datum comprises a plurality of initial data; said initial data storage device stores said plurality of initial data;

and there is provided a selection device for selecting an initial datum to be renewed from said plurality of initial data.

DETAILED DESCRIPTION OF THE PREFERRED EMBODIMENTS

Now, embodiments of a conversion curve setting system of the present invention will be described in detail below with reference to the accompanying drawings.

Figure 1:
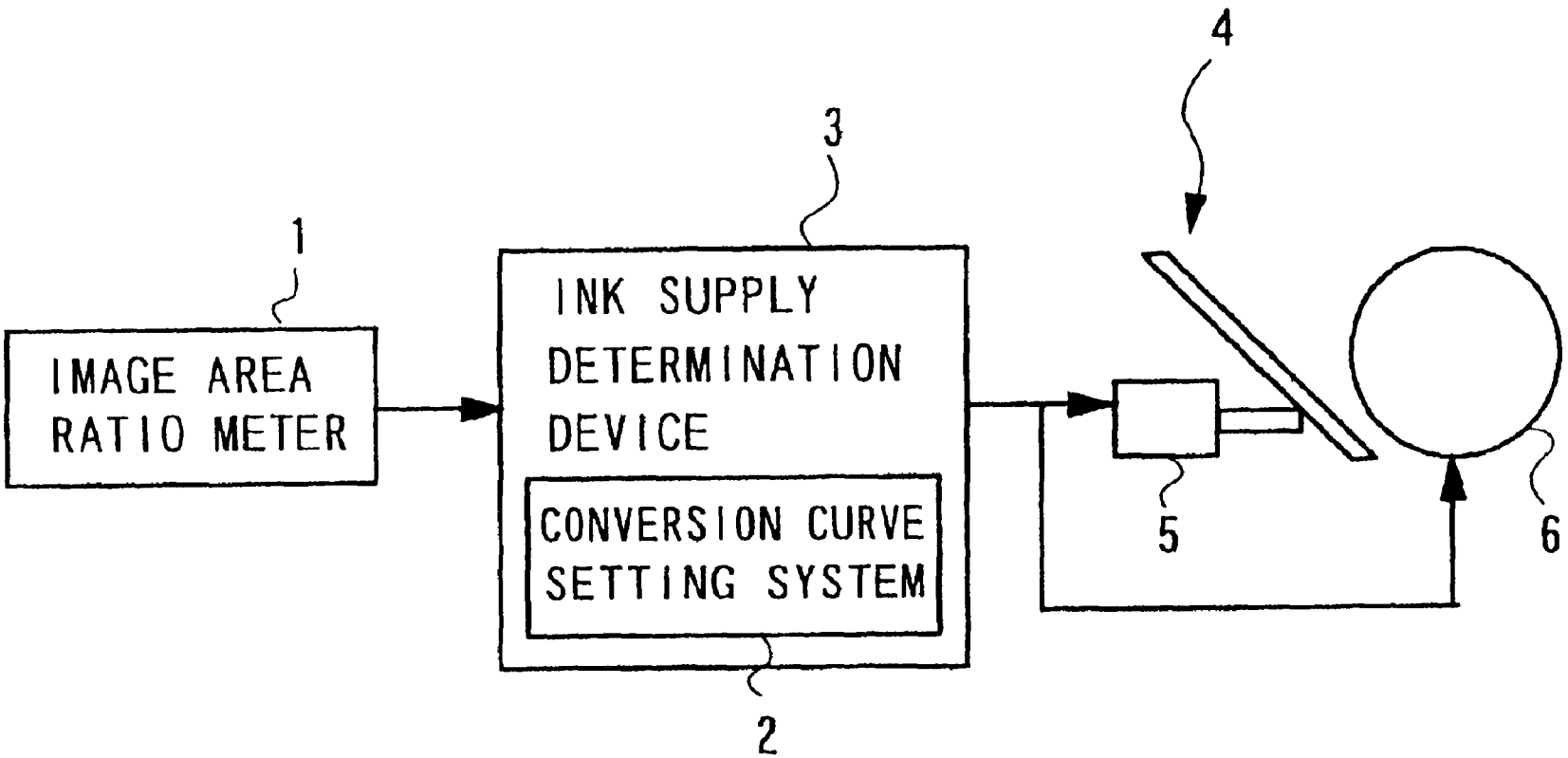
FIG. 1 is a view illustrating a structure of an ink supply apparatus to which a conversion curve setting system of the present invention is applied.

FIG. 1 illustrates a structure of an ink supply apparatus to which a conversion curve setting system of the present invention is applied. The ink supply apparatus is used for a printing machine such as an offset web press. The ink supply apparatus comprises an image area ratio meter 1 for measuring an image area ratio of a press plate; an ink supply determination device 3 including the conversion curve setting system 2; and ink key devices 5 and a roller device 6 that serve as an ink supply adjusting apparatus 4 for adjusting amounts of supplied ink on the basis of a signal from the ink supply determination device 3. Each of the ink key devices 5 has a function of adjusting the opening of the ink key, i.e., the gap between the front end of the ink key of the ink key device 5 and the roller device 6. The roller device 6 includes a controller for adjusting the number of rotations of an ink fountain roller. Adjustment of the respective openings of the ink keys causes the printing density of the respective ink keys to vary. Increase or decrease in the number of rotations of the ink fountain roller causes the printing density in the whole area to vary.

Figure 2:
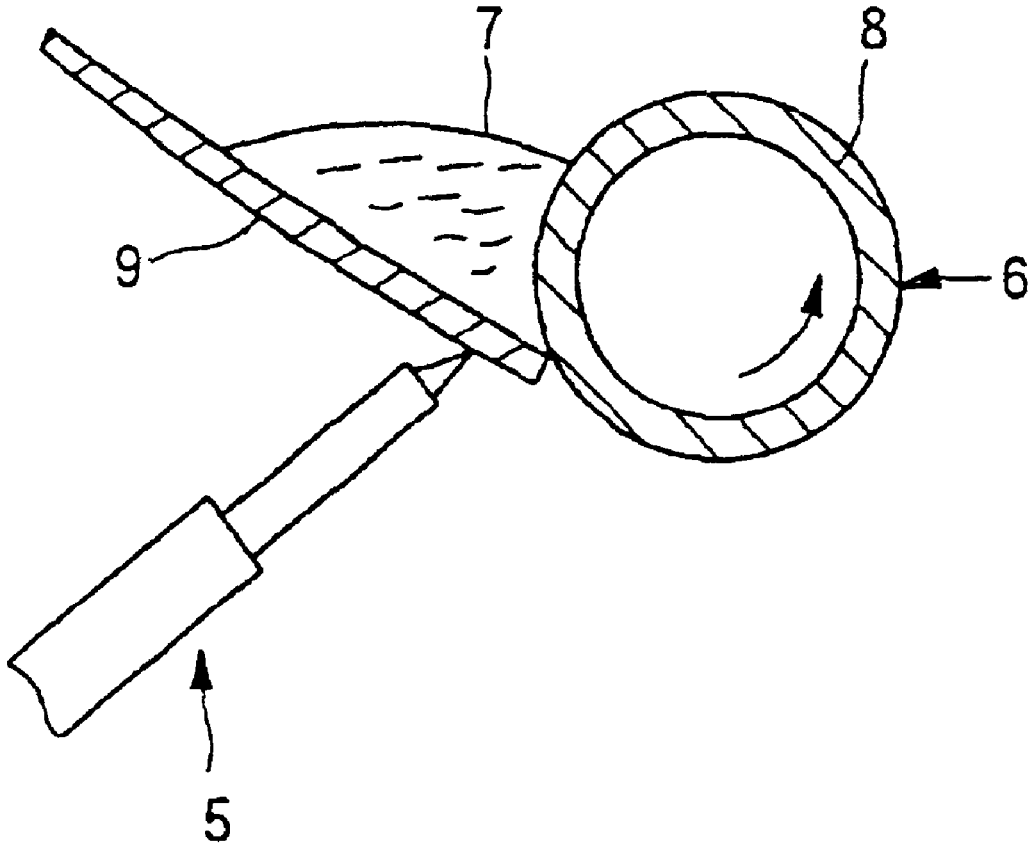
FIG. 2 is a cross sectional view illustrating an ink key device and a roller device.

FIG. 2 illustrates one of the ink key devices 5 and the roller device 6, which are operated under the control of the ink supply determination device 3. Rotation of the ink fountain roller 8 causes ink received in an ink fountain 7 to be applied on the ink fountain roller 8 from the gap between the ink fountain roller 8 and the front end of the ink key 9 so as to supply the ink. A plurality of ink keys is located in the longitudinal direction of the ink fountain roller 8 at the bottom of the ink fountain 7. Each of the ink key devices 5 has a function of making an independent adjustment of the opening, i.e., the gap between the outer periphery of the ink fountain roller 8 and the front end of the ink key 9.

Figure 3:
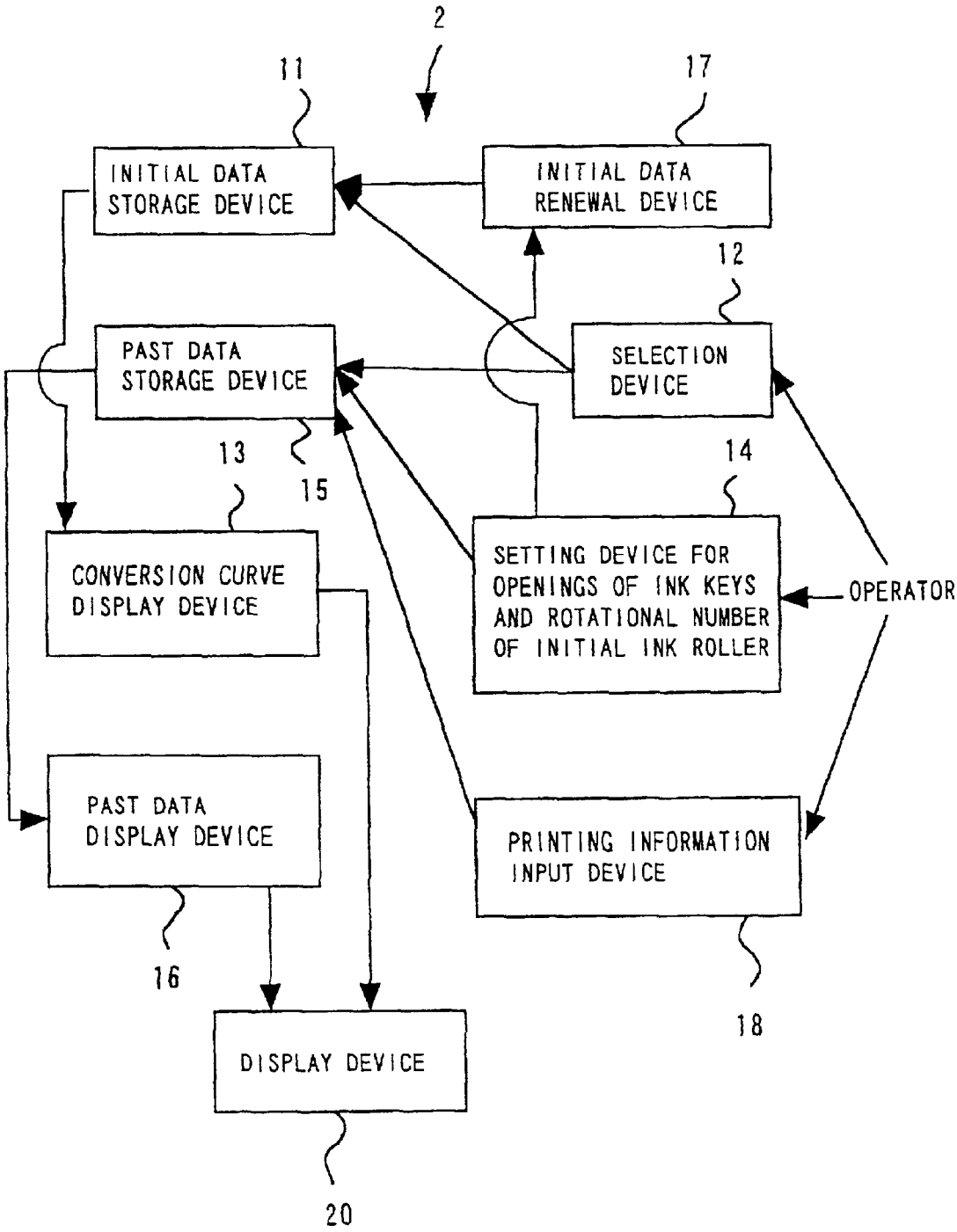
FIG. 3 is a block diagram of the conversion curve setting system.

FIG. 3 illustrates a block diagram of the conversion curve setting system 2. The conversion curve setting system has an initial data storage device 11, a selection device 12, a conversion curve display device 13, a setting device 14, a past data storage device 15, a past data display device 16 and a initial data renewal device 17. The initial data storage device 11 stores initial data, which defines the openings of the ink key devices and the number of rotations of the ink fountain roller relative to the image area ratio. The selection device 12 selects an initial datum to be renewed from the initial data, which are stored by the initial data storage device 11. The conversion curve display device 13 displays the conversion curve on the display device 20 on the basis of the initial datum to be renewed. The setting device 14 sets the openings of the ink keys 9 and the number of rotations of the ink fountain roller 8 through operation of an operator. The past data storage device 15 stores past data of the openings of the ink keys 9 and the number of rotations of the ink fountain roller 8 relative to the image area ratio, which have been set by the setting device 14. The past data display device 16 displays the past data stored by the past data storage device 15, together with the conversion curve on the display device 20. The initial data renewal device 17 renews the initial data on the basis of the openings of the ink key devices and the number of rotations of the ink fountain roller relative to the image area ratio, which have been set by the setting device 14.

The conversion curve setting system 2 includes a printing information input device 18 for inputting printing information related to the past data through operation by the operator. The past data storage device 15 stores the printing information, which has been input by the printing information input device 18. The past data display device 16 displays the printing information, which has been stored by the past data storage device 15, on the display device 20. The printing information related to the past data may include information having an influence on printing results, i.e., the name of ink, ink temperature, kind of additive, a date, a work number, the name of customer, a file name as printed, and the like. The printing information may be input into a text box, which has previously been formatted. Alternatively, it may optionally be input into a text box, which has not as yet been formatted. The conversion curve setting system 2 may include an image file storage device for storing image files, which have already been subjected to a printing operation, and an image file display device for displaying the image files related to the past data on the display device 20.

The conversion curve setting system 2 can be operated by means of a conventional computer such as a personal computer or the like. The initial data storage device 11, the past data storage device 15 and the image file storage device may comprise the conventional storage medium such as a memory or a hard disc, which is housed in the computer, or a floppy disc or the like. The conversion curve display device 13, the past data display device 16 and the image file display device may comprise a central processing unit (CPU) of the computer for executing a display program software for the display of the conversion curve and the past data. The display device 20 may comprise a display device such as a cathode ray tube (CRT) color display device, a liquid crystal display (LCD) device or the like. The conversion curve display device 13 graphically displays the conversion curve in the form of a line graph on the display device 20. The past data display device 16 plots the past data on the above-mentioned line graph. An operator can set the openings of the ink key devices 5 and the number of rotations of the ink fountain roller 8 relative to the optimum image area ratio, making reference to the past openings of the ink keys and the past number of rotations of the ink fountain roller relative to the image area ratio, which are displayed on the display device 20. The initial data renewal device 17 may comprise the central processing unit (CPU) of the computer, a program software for operating the CPU, and the other optional component. The setting device 14, the printing information input device 18, and the selection device 12 may comprise an input device such as a keyboard, a mouse and the like, which are to be operated by an operator, a graphical user interface device for receiving instructions from the above-mentioned input device so as to display setting buttons, setting conditions and the like on the display device 20.

Figure 4:
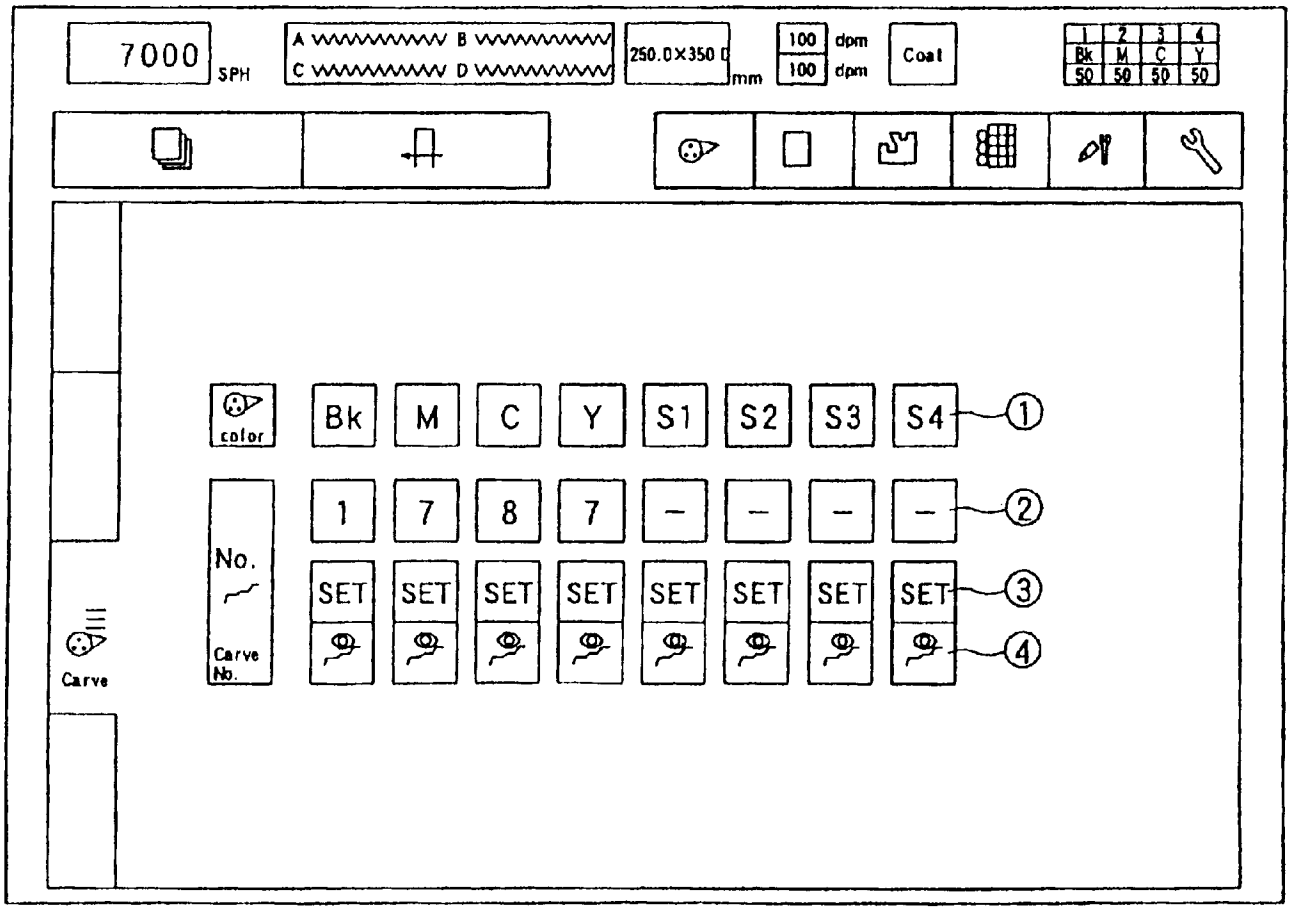
FIG. 4 is a view illustrating allocation of the conversion curve for the respective colors, which is displayed on the display device.

FIG. 4 illustrates allocation of the conversion curve for the respective colors ①, which is displayed on the display device. The conversion curve is allocated to the ink supply adjustment device 4 for each color. When a printing operation is carried out using for example four colors of black (Bk), magenta (M), cyan (C) and yellow (Y), the four conversion curves are allocated to the four ink supply adjustment devices 4, respectively. A plurality of numerals ② for example of 1 through 99 has previously been allotted to the conversion curve. Operation of conversion curve setting control buttons ③ by an operator causes the numeral ② for the conversion curve for each color to be allocated. Allocation of the numeral ② for the conversion curve that is considered to be closest to the printing conditions by the operator is made by him. When confirmation of the allocated conversion curve for the respective color is required, a click operation of conversion curve confirmation buttons ④ by the operator causes the conversion curve to be displayed in the form of line graph.

Now, description will be given of a flow for setting any one of the conversion curves Nos. 1 to 99 and making modification of it. Modification of the conversion curve is made, when a better printing result is required after carrying out the actual printing operation mainly with the use of the conversion curves allocated for the respective colors. When the printing result is improved and satisfied, the modified conversion curve is registered. It is impossible to modify for example the conversion curves Nos. 1 to 30 of the conversion curves Nos. 1 to 99. A flow for modifying the conversion curve No. 53 will be described below.

Figure 5:
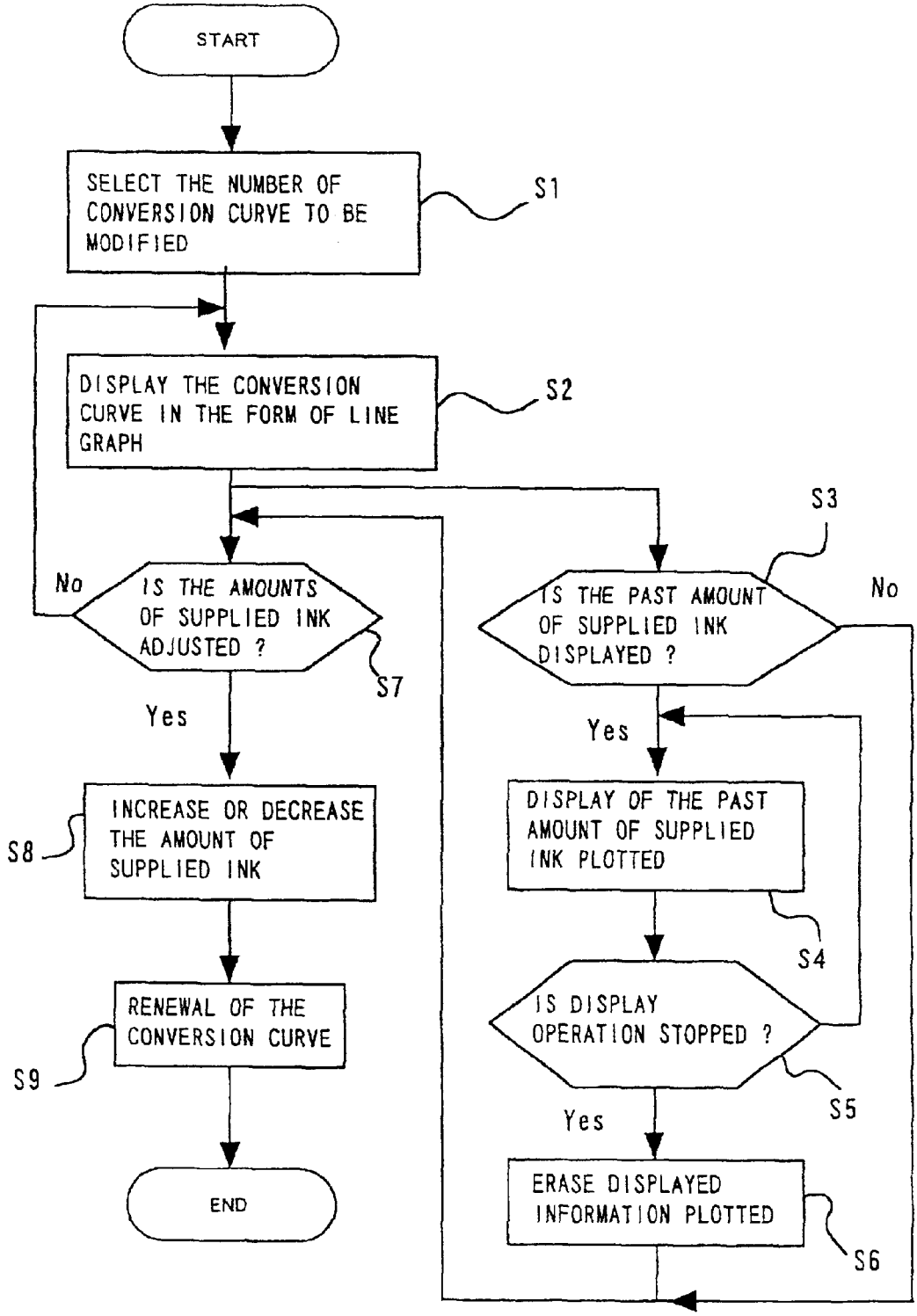
FIG. 5 is a flowchart illustrating the setting of the conversion curve.
Figure 6:
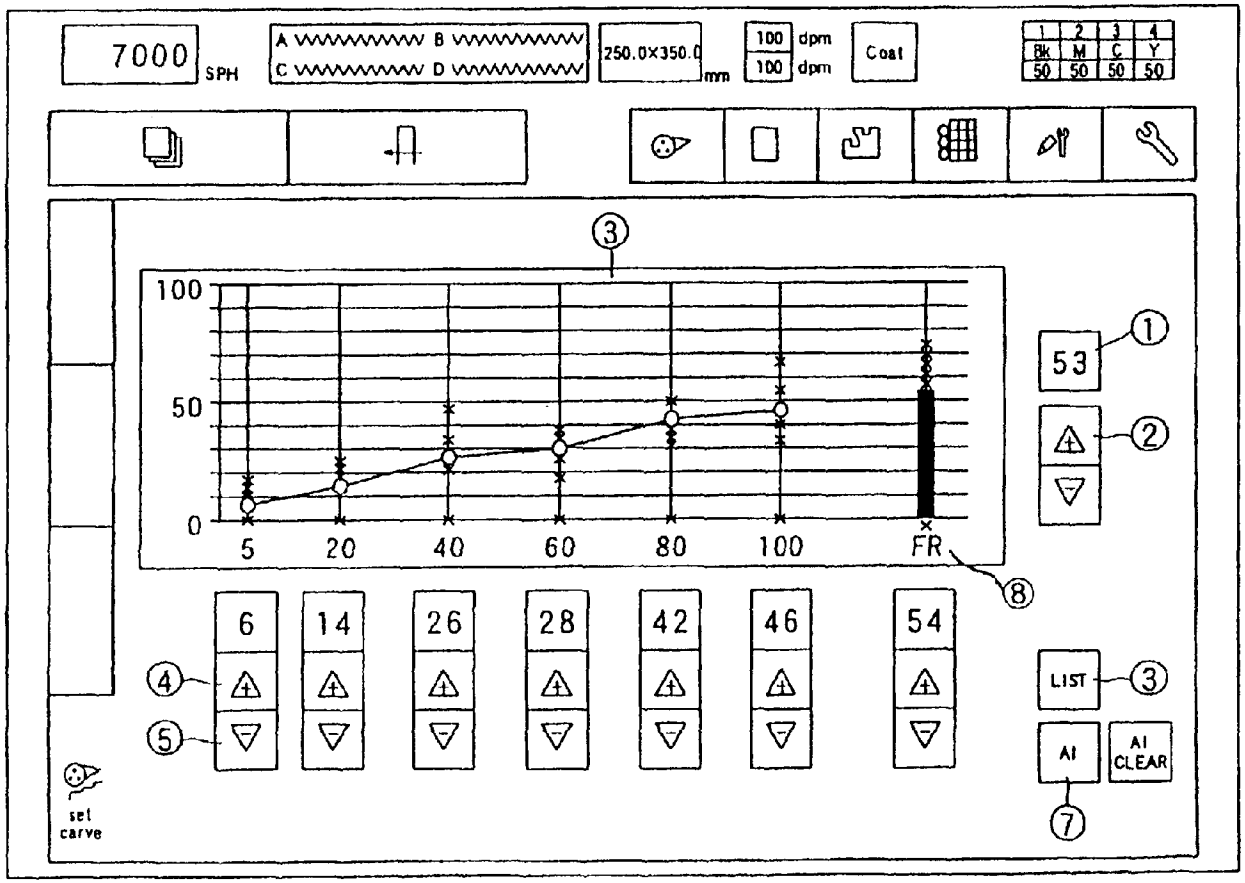
FIG. 6 is a view illustrating the conversion curve and the past data, which are displayed on the display device.

FIG. 5 illustrates a flow for setting the conversion curve. FIG. 6 illustrates the conversion curve and the past data, which are displayed on the display device 20. First, the number of the conversion curve to be modified is selected (Step S1). The display device 20 displays the number ① of the conversion curve to be modified, as shown in FIG. 5. Operation of the selection device ② by an operator causes the conversion curve number to increase or decrease so as to select the number ① of the conversion curve to be modified. Then, the conversion curve to be modified is displayed in the form of a line graph on the display device 20 (Step S2). The opening of the ink key and the number of rotations of the ink fountain roller are plotted in ordinate of the line graph and the image area ratio is plotted in abscissa thereof. In the embodiment, the abscissa indicating the image area ratio has the marked scales of 5, 20, 40, 60, 80 and 100. Adjacent two of points indicating the openings of the ink keys corresponding to these marked scales are connected to each other by a straight line. The number of rotations of the ink fountain roller is displayed by the indication of "FR" ⑧. The initial data storage device 11 defines the initial data with the number of 1 to 99, i.e., the openings of the ink keys and the number of rotations of the ink fountain roller relative to the image area ratio, which initial data correspond to the conversion curves Nos. 1 to 99. The conversion curve system 2 accesses the initial data corresponding to the number of the conversion curve to be modified. The conversion curve display device 13 displays the conversion curve on the graph ③. Then, there is judged as whether or not the button ⑦ (see FIG. 6) used to display the past data of the amounts of supplied ink has already been clicked by an operator (Step S3). After the button ⑦ is clicked, the past data display device 16 plots the past data, which include the openings of the ink keys and the number of rotations of the ink fountain roller relative to the image area ratio, on the graph ③ of the conversion curve (Step S4). The past data storage device 15 stores the openings of the ink keys and the number of rotations of the ink fountain roller relative to the image area ratio, which have previously been set by means of the setting device 14. The past data are indicated in the form of symbol "x" on the line graph. The click operation on the symbol "x" by an operator may cause information having an influence on printing results, i.e., the name of ink, ink temperature, kind of additive, a date, a work number, the name of customer, a file name as printed, and the like to be displayed or the image file, which had already been subjected to a printing operation, to be displayed on the display device 20. Then, there is judged as whether or not the button ⑦ has been clicked again by the operator to stop the display operation of the past data of the amounts of supplied ink (Step S5). After the button ⑦ is clicked again, the past data display device 16 stops the plot display operation (Step S6).

Then, there is judged as whether or not the operator has given his instructions on adjustment of the openings of the ink keys and the number of rotations of the ink fountain roller relative to the image area ratio (Step S7). The operator sets the openings of the ink keys and the number of rotations of the ink fountain roller for the respective image area ratio with the use of the setting device 14, making reference to the openings of the ink keys and the number of rotations of the ink fountain roller, which have previously been set, as described above. After the completion of the setting operation of the openings of the ink keys and the number of rotations of the ink fountain roller with the use of the setting device 14, the conversion curve setting system increases or decreases the openings of the ink keys and the number of rotations of the ink fountain roller (Step S8). A dragging operation of the respective points (i.e., circular symbols) on the marked scales of 5, 20, 40, 60, 80 and 100 for the image area ratio, as shown in FIG. 6, permits change in opening of the ink keys (to make a coarse adjustment). In addition, the click operation of ink supply change buttons ⑤ permits increase or decrease in the openings of the ink keys and the number of rotations of the ink fountain roller (to make a fine adjustment). The set values ④ of the openings of the ink keys and the number of rotations of the ink fountain roller are displayed on the display device 20. Then, the initial data renewal device 17 renews the modified conversion curve (Step S9). The initial data storage device 11 stores the data of the modified conversion curve.

According to the present invention as described in detail, an operator can set the conversion curve, making reference to the past data of the setting conditions for the amounts of supplied ink of the ink supply adjusting apparatus relative to the image area ratio. It is therefore possible to set the optimum conversion curve, even when there occurs change in ambient temperature, adjusting condition of components of the printing machine, a kind of ink to be used, a pattern to be printed and the like. It is also easy for an operator to make a comparison between the past data and the conversion curve. It is also possible for the operator to confirm the printing information on the past data so as to set the optimum conversion curve. It is also possible to renew the conversion curve into the optimum conversion curve. It is also possible to set the optimum conversion curve for the respective color in the ink supply adjusting apparatus.

What is claimed is:

1. A conversion curve setting system comprising:

an initial data storage device for storing at least one initial datum, said at least one initial datum defining setting conditions for amounts of supplied ink of an ink supply adjusting apparatus relative to an image area ratio;

a conversion curve display device for displaying a conversion curve on a display device on the basis of said at least one initial datum stored by said initial data storage device;

a setting device for setting the setting conditions for the amounts of supplied ink of the ink supply adjusting apparatus relative to the image area ratio, through operation by an operator;

a past data storage device for storing past data of the setting conditions for the amounts of supplied ink of the ink supply adjusting apparatus relative to the image area ratio, which setting conditions have been set by said setting device; and a past data display device for displaying said past data stored by said past data storage device, together with said conversion curve on said display device.

2. The conversion curve setting system as claimed in claim 1, wherein:

said conversion curve display device displays said conversion curve in the form of a graph on said display device; and said past data display device plots said past data on said graph.

3. The conversion curve setting system as claimed in claim 1, wherein:

there is provided a printing information input device for inputting printing information related to said past data through operation by the operator;

said past data storage device stores said printing information inputted by said printing information input device; and said past data display device displays said printing information stored by said past data storage device on said display device.

4. The conversion curve setting system as claimed in claim 2, wherein:

there is provided a printing information input device for inputting printing information related to said past data through operation by the operator;

said past data storage device stores said printing information inputted by said printing information input device; and said past data display device displays said printing information stored by said past data storage device on said display device.

5. The conversion curve setting system as claimed in claim 1, further comprising:

an initial data renewal device for renewing said at least one initial datum on the basis of data of the setting conditions for the amounts of supplied ink of the ink supply adjusting apparatus relative to the image area ratio, which setting conditions have been set by said setting device.

6. The conversion curve setting system as claimed in claim 2, further comprising:

an initial data renewal device for renewing said at least one initial datum on the basis of data of the setting conditions for the amounts of supplied ink of the ink supply adjusting apparatus relative to the image area ratio, which setting conditions have been set by said setting device.

7. The conversion curve setting system as claimed in claim 3, further comprising:

an initial data renewal device for renewing said at least one initial datum on the basis of data of the setting conditions for the amounts of supplied ink of the ink supply adjusting apparatus relative to the image area ratio, which setting conditions have been set by said setting device.

8. The conversion curve setting system as claimed in claim 4, further comprising:

an initial data renewal device for renewing said at least one initial datum on the basis of data of the setting conditions for the amounts of supplied ink of the ink supply adjusting apparatus relative to the image area ratio, which setting conditions have been set by said setting device.

9. The conversion curve setting system as claimed in claim 1, wherein:

said at least one initial datum comprises a plurality of initial data;

said initial data storage device stores said plurality of initial data; and there is provided a selection device for selecting an initial datum to be renewed from said plurality of initial data.

10. The conversion curve setting system as claimed in claim 2, wherein:

said at least one initial datum comprises a plurality of initial data;

said initial data storage device stores said plurality of initial data; and there is provided a selection device for selecting an initial datum to be renewed from said plurality of initial data.

11. The conversion curve setting system as claimed in claim 3, wherein:

said at least one initial datum comprises a plurality of initial data;

said initial data storage device stores said plurality of initial data; and there is provided a selection device for selecting an initial datum to be renewed from said plurality of initial data.

12. The conversion curve setting system as claimed in claim 4, wherein:

said at least one initial datum comprises a plurality of initial data;

said initial data storage device stores said plurality of initial data; and there is provided a selection device for selecting an initial datum to be renewed from said plurality of initial data.

13. The conversion curve setting system as claimed in claim 5, wherein:

said at least one initial datum comprises a plurality of initial data;

said initial data storage device stores said plurality of initial data; and there is provided a selection device for selecting an initial datum to be renewed from said plurality of initial data.

14. The conversion curve setting system as claimed in claim 6, wherein:

said at least one initial datum comprises a plurality of initial data;

said initial data storage device stores said plurality of initial data; and there is provided a selection device for selecting an initial datum to be renewed from said plurality of initial data.

15. The conversion curve setting system as claimed in claim 7, wherein:

said at least one initial datum comprises a plurality of initial data;

said initial data storage device stores said plurality of initial data; and there is provided a selection device for selecting an initial datum to be renewed from said plurality of initial data.

16. The conversion curve setting system as claimed in claim 8, wherein:

said at least one initial datum comprises a plurality of initial data;

said initial data storage device stores said plurality of initial data; and there is provided a selection device for selecting an initial datum to be renewed from said plurality of initial data.

* * * * *